US005252938A

United States Patent [19]

Bishop

[11] Patent Number: 5,252,938

[45] Date of Patent: Oct. 12, 1993

[54] SOLENOID WITH ARMATURE BIASED TOWARDS THE REST POSITION WITH TWO SPRINGS

[75] Inventor: Frederick J. Bishop, Wolverhampton, England

[73] Assignee: Lucas Industries public limited company, West Midlands, England

[21] Appl. No.: 840,014

[22] Filed: Feb. 24, 1992

[30] Foreign Application Priority Data

Feb. 27, 1991 [GB] United Kingdom ..... 9104047

[51] Int. Cl.[5] ..... H01F 7/08; H01F 7/13

[52] U.S. Cl. ..... 338/274; 335/260; 335/270

[58] Field of Search ..... 335/249, 255, 261, 258, 335/262, 270, 273, 274, 281, 279

[56] References Cited

U.S. PATENT DOCUMENTS

| | | | |
|---|---|---|---|
| 2,753,470 | 7/1956 | Armstrong . | |
| 2,840,769 | 6/1958 | Currie . | |
| 2,859,392 | 11/1958 | Van Ryan et al. . | |
| 3,200,222 | 8/1965 | Hawkins . | |
| 3,265,941 | 8/1966 | Lory . | |
| 4,267,897 | 5/1981 | Takeshima | 335/262 |
| 4,540,965 | 9/1985 | Hattori et al. | 335/259 |
| 4,579,146 | 4/1986 | Tsuru et al. . | |
| 4,635,683 | 1/1987 | Nielsen | 335/274 |
| 4,755,781 | 7/1988 | Bogner | 335/255 |
| 4,983,941 | 1/1991 | Tanaka | 335/255 |

FOREIGN PATENT DOCUMENTS

| | | |
|---|---|---|
| WO90/01614 | 2/1990 | PCT Int'l Appl. . |
| 1003200 | 9/1965 | United Kingdom . |

*Primary Examiner*—Leo P. Picard
*Assistant Examiner*—Raymond Barrera
*Attorney, Agent, or Firm*—Trexler, Bushnell, Giangiorgi & Blackstone, Ltd.

[57] ABSTRACT

A solenoid having an armature movable with respect to a stator from a rest position to an energized position when a coil is energized. Two return devices, for instance helical compression springs, urge the armature to return to the rest position. Two slidable sleeves are provided between stator and the armature. Ingress of dirt into the armature may jam either sleeve with respect to the stator or the armature without jamming the solenoid, since the other return devices/sleeve combination will still permit movement of the armature.

11 Claims, 1 Drawing Sheet

SOLENOID WITH ARMATURE BIASED TOWARDS THE REST POSITION WITH TWO SPRINGS

BACKGROUND OF THE INVENTION

The present invention relates to a solenoid. Such a solenoid may be used as an actuator in various applications.

A known type of solenoid comprises a coil or winding of a conductor on a ferromagnetic stator. The stator is hollow and contains a ferromagnetic armature which is movable rectilinearly inside the stator. Once sufficient electric current is supplied to the coil, the armature moves axially of the coil. A return spring is provided to return the armature to a rest position when current to the coil is interrupted.

Solenoid actuators of this type are in widespread use and generally function satisfactorily. However, in hostile environments and/or in critical applications where failsafe operation is required, problems can arise in ensuring that the armature returns to its rest position when the coil current is interrupted. For instance, if the return spring breaks, then the restoring force is lost and the armature may not return to its rest position. Also, if the armature becomes bent or if contaminants such as particles of dirt enter the gap between the armature and the stator, the armature can become locked in the actuated position and the return spring may be incapable of returning the armature to the rest position.

OBJECTS AND SUMMARY OF THE INVENTION

According to the present invention, there is provided a solenoid comprising a stator including an electromagnetic coil, an armature movable with respect to the stator from a rest position to an energised position when the coil is energised, and first and second return means, each of which urges the armature towards the rest position.

The armature may be arranged to perform substantially rectilinear motion with respect to the stator when moving between the rest position and the energised position.

Preferably one or each of the first and second return means comprises a spring, such as a helical compression spring.

Preferably the first return means acts between the stator and a first sleeve which is movable with respect to the stator and the armature and which is urged by the first return means against the armature, for instance against a first shoulder of the armature.

Preferably the second return means acts between the armature, for instance a second shoulder thereof, and a second sleeve which is movable with respect to the armature and the stator and which is urged by the second return means against the stator.

Preferably the first and second sleeves are made of non-ferromagnetic material. Preferably the second sleeve abuts against a non-ferromagnetic part of the stator.

It is thus possible to provide a solenoid actuator which cannot be prevented from returning to its rest position by a single failure when the electromagnetic coil is de-energised. The reliability of the solenoid actuator is thus greatly improved, allowing it to be used in critical applications and in hostile environments where failure to return to the rest position would have undesirable or unacceptable results.

BRIEF DESCRIPTION OF THE DRAWINGS

The invention will be further described, by way of example, with reference to the accompanying drawing.

DETAILED DESCRIPTION OF THE PREFERRED EMBODIMENT

Figure 1:
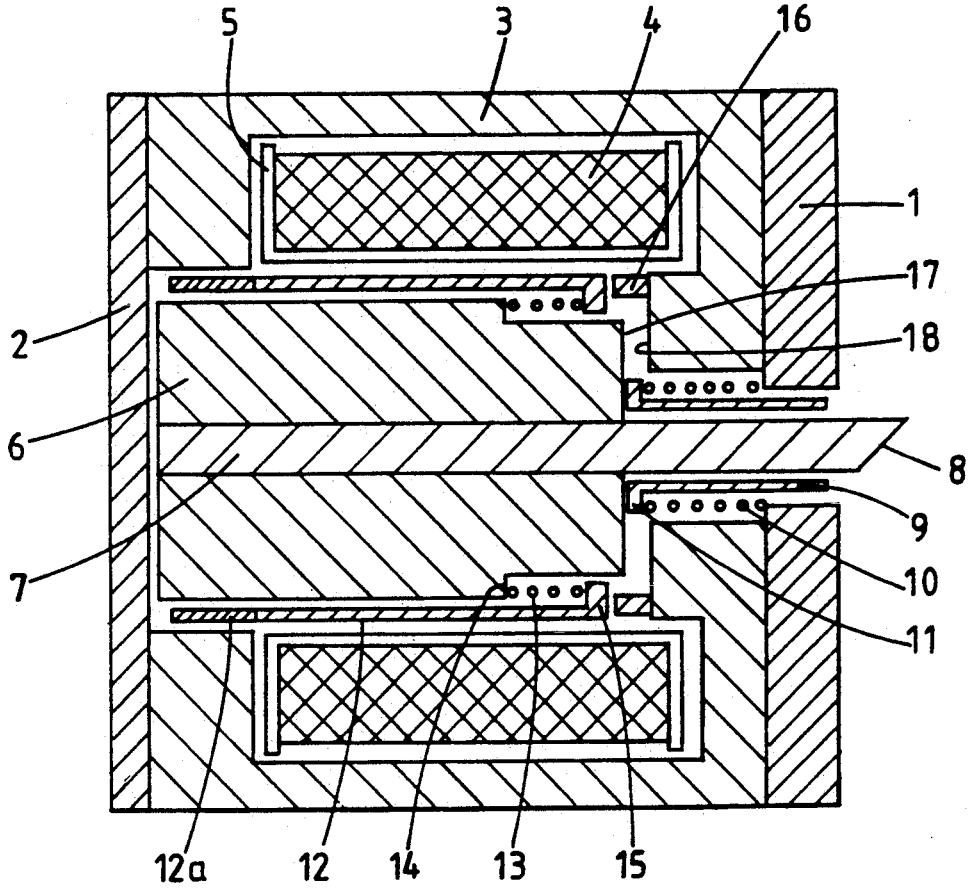
FIG. 1 is a cross sectional view of a solenoid actuator constituting an embodiment of the invention.

The solenoid actuator comprises a stator composed of a non-ferromagnetic front plate 1 and a non-ferromagnetic rear plate 2 fixed to opposite ends of a ferromagnetic pole piece 3. An electromagnetic coil 4 is wound on an electrically insulating former 5, for instance of plastics material, and is fixed inside the pole piece 3.

An armature comprises a ferromagnetic member 6 attached to a non-ferromagnetic rod 7 which passes through the centre thereof. An end 8 of the rod is chamfered and extends through an opening in the front end plate 1 so as to provide an output member of the solenoid.

A sleeve 9 is mounted on the rod 7 adjacent the end 8 so as to be slidable with respect to the rod and with respect to the stator. Thus, the rod forms a clearance fit inside the sleeve 9 and the sleeve 9 is a clearance fit in the aperture in the front plate 1. A helical spring 10 is held in compression between a region of the front plate 1 surrounding the aperture and a shoulder 11 formed at an inner end of the sleeve 9. The spring 10 thus urges the sleeve 9 against the armature which, in turn, is urged towards an end stop, such as the rear end plate 2.

Another cylindrical sleeve 12 surrounds the member 6, which is a clearance fit within the sleeve 12. The sleeve 12 is a clearance fit within the stator, and is therefore slidable with respect to the stator and with respect to the armature. Another coil spring 13 is held in compression between a shoulder 14 of the member 6 and a shoulder 15 formed at one end of the sleeve 12. Movement of the sleeve 12 to the right in the drawing is limited by abutment on a ring 16 which is fixed to the pole piece 3. The spring 13 thus urges the armature to the left in the drawing.

The sleeve 9 and the ring 16 are made of non-ferromagnetic material. The sleeve 12 is mainly made of non-ferromagnetic material but has an end portion **12*a* made of ferromagnetic material so as to reduce the effective width of the air gap between the pole piece 3 and the member 6**.

In use, in the absence of electric current through the coil 4, the springs 10 and 13 hold the armature in its rest position against the end plate 2. When the coil 4 is energised, it attracts the ferromagnetic member 6 such that an end face 17 of the member 6 is urged towards an inner end face 18 of the pole piece 3 and the end 8 of the rod 7 moves to the right in the drawing. This movement is limited by abutment of the end face 17 of the member 6 against the inner end face 18 of the pole piece 3. When the coil 4 is de-energised, the springs 10 and 13 return the armature to its rest position.

If one of the springs 10 and 13 fails, the other is still capable of returning the armature to its rest position. If the sleeve 12 fouls against the stator, operation of the solenoid actuator is not affected as movement of the sleeve 12 is not required for correct operation. If the sleeve 12 becomes fixed to the member 6, for instance because of the ingress of a particle of foreign material therebetween, the spring 13 ceases to act but the spring 10 continues to urge the armature towards its rest position.

If the sleeve 9 becomes fixed to the stator, for instance because of the ingress of a particle of foreign material between the sleeve 9 and the end plate 1, the spring 10 ceases to provide a restoring force for the armature. However, the spring 13 continues to urge the armature towards its rest position. If the sleeve 9 becomes fixed to the rod 7, for instance because of the ingress of a particle of foreign material or because of bending of the rod so as to foul the sleeve 9, the spring 10 continues to provide a restoring force.

The solenoid actuator is thus immune to the effects of a single failure in the restoring force system. Further, the actuator is immune to some double failures, such as fouling of the sleeve 9 by the rod 7 and fouling of the sleeve 12 on the stator. In this particular example, the actuator is immune to three failures, since failure of either spring in these circumstances will not prevent the other spring from providing a restoring force.

The reliability of the solenoid actuator is therefore greatly improved compared with actuators of known type. Further, the construction and manufacture of the actuator are not significantly more complicated than for known types of actuators. The solenoid actuator is therefore suitable for use in critical applications where failure of the armature to return to its rest position when the coil is de-energised must be avoided for single failures within the solenoid. Further, the actuator may be used with improved reliability in hostile environments where the chances of contaminants entering the actuator are significant.

Various modifications may be made within the scope of the invention. For instance, one or more force sensors may be provided to monitor the restoring force on the armature provided by the springs 10 and 13. Such a sensor arrangement can be used to detect a reduced restoring force in order to provide an indication that a fault or failure has occurred so as to prevent a "hidden" failure from going undetected.

I claim:

1. A solenoid comprising a stator, an armature, a first return means, a second return means, a first sleeve movable with respect to said stator and said armature and a second sleeve movable with respect to said armature and said stator, said stator comprising an electromagnetic coil, said armature being movable with respect to said stator from a rest position to an energised position when said coil is energised, said first return means being arranged to act between said stator and said first sleeve to urge said first sleeve against said armature and thereby to urge said armature towards the rest position and said second return means being arranged to act between said armature and said second sleeve to urge said second sleeve against said stator and thereby urge said armature towards the rest position.

2. A solenoid as claimed in claim 1, in which said armature is arranged to perform substantially rectilinear motion with respect to said stator when moving between the rest position and the energised position.

3. A solenoid as claimed in claim 1, in which said first return means comprises a spring.

4. A solenoid as claimed in claim 3, in which the spring is a helical compression spring.

5. A solenoid as claimed in claim 1, in which said second return means comprises a spring.

6. A solenoid as claimed in claim 5, in which said spring is a helical compression spring.

7. A solenoid as claimed in claim 1, in which said armature further comprises a first shoulder and in which said first sleeve is urged against said first shoulder.

8. A solenoid as claimed in claim 1, in which said armature further comprises a second shoulder and in which said second return means acts against said second shoulder.

9. A solenoid as claimed in claim 1, in which said first sleeve is made of non-ferromagnetic material.

10. A solenoid as claimed in claim 1, in which said second sleeve is made of non-ferromagnetic material.

11. A solenoid as claimed in claim 1, in which said second sleeve abuts against a non-ferromagnetic part of the stator.

* * * * *